US006516812B2

(12) United States Patent
Chang

(10) Patent No.: US 6,516,812 B2
(45) Date of Patent: Feb. 11, 2003

(54) ANTIBACTERIAL ARTIFICIAL FINGERNAIL AND METHOD FOR PRODUCTION THEREOF

(75) Inventor: Sung Yong Chang, Roslyn Heights, NY (US)

(73) Assignee: KMC Exim Corp., Port Washington, NY (US)

( * ) Notice: Subject to any disclaimer, the term of this patent is extended or adjusted under 35 U.S.C. 154(b) by 106 days.

(21) Appl. No.: 09/759,585

(22) Filed: Jan. 11, 2001

(65) Prior Publication Data

US 2002/0129827 A1 Sep. 19, 2002

(51) Int. Cl.[7] ..... A45D 29/00; A45D 29/18
(52) U.S. Cl. ..... 132/73; 132/73.5
(58) Field of Search ..... 132/73, 73.5; 424/61, 424/63; 523/113

(56) References Cited

U.S. PATENT DOCUMENTS 4,222,399 A 9/1980 Ionescu
4,587,983 A * 5/1986 Wissman et al. ..... 132/73
4,596,260 A 6/1986 Giuliano
4,646,765 A * 3/1987 Cooper et al.
4,669,491 A * 6/1987 Weiberg et al. ..... 132/73
4,682,612 A 7/1987 Giuliano
4,690,369 A 9/1987 Giuliano
4,718,957 A 1/1988 Sensenbrenner
4,844,102 A * 7/1989 Repnsek et al. ..... 132/73
4,920,991 A 5/1990 Shibahashi et al.
5,830,442 A * 11/1998 Beaver ..... 424/61
5,977,205 A * 11/1999 Messere et al. ..... 523/113
6,281,265 B1 * 8/2001 Montgomery et al. ..... 523/122

* cited by examiner

*Primary Examiner*—John J. Wilson
*Assistant Examiner*—Robyn Kieu Doan
(74) *Attorney, Agent, or Firm*—Hoffmann & Baron, LLP

(57) ABSTRACT

The present invention relates to an artificial nail with excellent antibacterial effects. In addition, the present invention concerns a method for manufacturing the antibacterial nail, wherein ABS resin material and an antibacterial agent are mixed together. The mixture is then compressed to make resin pellets, and the pellets are molded into an artificial nail by injection molding.

9 Claims, No Drawings

ANTIBACTERIAL ARTIFICIAL FINGERNAIL AND METHOD FOR PRODUCTION THEREOF

BACKGROUND

The present invention relates to the art of ornamental accessories for fingernails. In particular, the present invention relates to an artificial nail with excellent antibacterial effects, and method of making the same.

One of the human body parts that is focused on by the modern beauty industry is the fingernails. It is recognized that well-groomed and beautifully colored long nails are an essential beauty element because they enhance the feminine side and beauty of modern women. Therefore, modern women spend more time and effort on nail beautification. However, many women find it very difficult or impossible to allow their natural fingernails to grow to a desired length. This is due to many factors including breakage of the natural fingernails and difficulty managing them.

One solution that can replace long, natural fingernails is to use an artificial nail. The artificial nail can cover the entire nail or can serve to extend the natural nail to the desired length. In general, it is a known art to attach an artificial nail with similar shape and desired length, to a natural nail to enhance the length and appearance of said natural nail.

Numerous patents on such artificial nails are known. U.S. Pat. No. 4,920,991 (Sibahashi et al.) describes an artificial nail that changes color with heat.

U.S. Pat. No. 4,682,612 (Giuliano) describes a method for manufacturing an artificial nail using a coating composition that can harden by ultraviolet rays.

In addition, U.S. Pat. No. 4,222,399 (Ionesku) describes artificial nails that are attached on top of an elastic, arch-shaped glue applied to a real nail. U.S Pat. No. 5,219,645 (Skoon) describes a method for manufacturing artificial nails by polymerization of cyanoacrylate saturated in a textile matrix.

In addition, U.S. Pat. No. 4,718,957 (Sensenbrener) describes a method for manufacturing reusable artificial nails using real nails or a real nail model, a second tool, and a separation material. U.S. Pat. No. 4,450,848 (Perigno) describes a method for manufacturing artificial nails that includes a cyanoacrylate adhesive layer, acrylic acid ester powder layer, and a second cyanoacrylate thin film.

Most of the artificial nails that are generally used, including those described in the aforementioned art, are produced by injection molding using a synthetic resin, such as ABS as a raw material. Because the raw material for nails is subject to high-temperature heating during the molding process, microbes like blue mildew do not grow. However, artificial nail consumers usually do not have the artificial nail attached for long periods. Actually, in the U.S., which is the largest market for artificial nails in the world, consumers tend to put the nail on using instant glue and leave it attached for 1–3 days in the short term, or 2–3 weeks in the long term.

The majority of nail consumers are women. Most women do both housework and various activities that expose their fingernails to foreign materials, dirt and moisture. The foreign materials, dirt and moisture can easily permeate between the artificial nail and the natural nail. As a result, when artificial nails are attached for more than two weeks, they become susceptible to bacteria, mildew and dirt which can produce serious damage to the nail.

Accordingly, it would be desirable to provide an artificial fingernail that can prevent the growth of bacteria, mildew and dirt even after the nail has been attached for a longer period, i.e., more than two weeks.

SUMMARY OF THE INVENTION

The present invention relates to an artificial nail with excellent antibacterial effects and a method for manufacturing the same. Antibacterial artificial nails of the present invention are manufactured by a method of injection molding a mixture of ABS resin powder and an antibacterial agent.

The weight of ABS resin powder present in the raw material of the antibacterial artificial nail of the present invention is 30–50% of the total weight of ABS resin pellet.

Organic and inorganic antibacterial agents employed in the present invention include powdered bactericides and/or antibacterial agents, particularly thiazole sulfuryl amide ($C_3H_3NS+SO_2(NH)_2$). Such an agent is made by Japan Applied Chemical Industry Ltd.

The raw material of antibacterial artificial nails of the present invention includes transparent ABS to obtain a transparent product, in addition to the aforementioned graft ABS resin. When such transparent ABS is present, the desired amount of such material is 10–25% of the total weight of the raw material. In addition, polymer styrene-acrylonitrile (SAN) is added to the graft ABS resin so as to achieve excellent molding properties during injection molding of the artificial nail and the strength required in the final product. The amount of SAN added is 30–40% of the total weight of the ABS resin pellets.

Along with the raw materials, the antibacterial artificial nail may include conventional additives, for example, a heat stabilizer. The additive content may be 3–4%.

Graft ABS resin can be obtained using conventional methods known in the art. For example, butadiene rubber, i.e., polybutadiene latex (PBL) prepared from butadiene polymerization reactions is copolymerized with acrylonitrile and styrene to obtain ABS copolymer which is then solidified, followed by dehydration and drying to prepare ABS powder. To the ABS powder, SAN, transparent ABS, antibacterial agents, and stabilizers are added in a ratio as mentioned above to prepare a mixture. This mixture is then compressed at 200–220° C. using a 2-axle mixer to obtain the raw material, ANS resin pellets.

As a result of the present invention, an artificial nail having excellent antibacterial effects and a method of manufacturing the same is provided. The antibacterial effects will allow for prolonged wearing of artificial fingernails without the complications of bacteria, mildew and dirt damaging the natural nail.

For a better understanding of the present invention, reference is made to the following description, taken in conjunction with the accompanying examples. The scope of the invention will be set forth in the appended claims.

DETAILED DESCRIPTION OF THE INVENTION

Usually, an artificial nail is shaped as a sheet or strip made of injection molded plastic, which is attached to the natural nail by using adhesives like ethyl cyanoacrylate on the underside of the artificial nail. Such injection molding methods are well known in the corresponding field. For example, the raw materials are mixed as mentioned above, and are then subjected to test injection. The injection-molding metal pattern is closed, a nozzle is introduced into the metal pattern, and the raw materials are plasticized by a rotating screw under injection pressure. Subsequently, the injection equipment is moved back to open the metal pattern, and the molded product is removed by pressure ejection. In general, artificial nails made from injection molding plastic are molded in various widths corresponding to the widths of fingernails. Artificial nails have a certain curvature so that the lower concave side of the artificial nail fits the upper convex side of the natural nail to provide ideal shape consistency.

The present invention is described below in more detail using experimental examples. However, the scope of the present invention is not limited to the experimental examples described below.

EXAMPLE 1

ABS copolymer was prepared by copolymerizing polybutadiene rubber, acrylonitrile, and styrene using conventional methods. This copolymer was solidified, dehydrated, and dried to make ABS powder. To this powder, SAN, transparent ABS, and thiazole sulfuryl amide as an antibacterial agent were mixed in a ratio as follows:

| Ingredient | Amount % |
|---|---|
| ABS powder | 40 |
| SAN | 35 |
| Transparent ABS | 20 |
| Antibacterial agent | 5 |

The mixture prepared was compressed through a 2-axle mixer at 200–220° C. to obtain ABS resin pellets. These pellets are the raw material for artificial nails and are used directly in injection molding processes to manufacture antibacterial artificial nails.

EXAMPLE 2

In this experimental example, the antibacterial effects were tested for the antibacterial artificial nail raw material prepared in Example 1 as described above. The test was done at the Japanese Food Analysis Center.

Test material was sampled from artificial nail ABS containing 5% antibacterial agent which was obtained in Example 1. The surface of the test material was washed with cotton soaked in 99.5% (v/v) ethanol, and air dried to prepare the test sample. *Escherichia coli* IFO 3072 (colon bacillus) was used as the test bacterium. The test culture medium is described below.

| | |
|---|---|
| NA culture medium: | normal agar culture medium |
| Nb culture medium: | normal bouillon culture medium containing 0.2% meat extract. |
| 1/500 NB culture medium: | NB culture medium is diluted 500 times with purified water, with pH adjusted to 7.0 ± 0.2. |
| SCDLP culture medium: | SCDLP culture medium (obtained from Nippon Seiyakoo Kabusikikayeeya). |
| SA culture medium: | standard agar culture medium. |

The bacterial solution was prepared as described below. After the test bacteria were cultured below 37±1° C. for 16–24 h, they were inoculated into NA medium, which was then cultured below 37±1° C. for 16–20 h. The cultured bacteria were dispersed homogeneously in 1/500 NB medium so that the number of bacteria per mL was $2.0\times 10^5$to $10\times10^6$.

Subsequently, 0.5 mL of *Escherichia coli* solution was dropped onto 25 $cm^2$ of test sample surface, on top of which polyethylene film was applied for sealing. The test sample prepared in such a way was kept at 25±1° C. with higher than 90% relative humidity. In addition, polyethylene film that did not contain antibacterial agents was employed as a control sample, which was also tested by the same method. After 72 h, the reproductivity of the test sample was measured as described below. After 72 h, remaining live bacteria were washed from the test sample in 10 mL of SCDLP medium. The number of live bacteria in said wash solution was measured by planar agar culture (35±1° C., culture for 2 days) using SA culture medium. The number of bacterium per test sample was calculated. Also, the number of bacteria immediately after inoculation was determined using a control sample.

The results of the number of live test bacteria dropped into the test sample are listed in the following table:

| Bacteria tested | Test sample | # of bacteria/ sample Immediately after inoculation | # of bacteria/sample at 25° C. after 72 h |
|---|---|---|---|
| *E. coli* | Control | $2.6 \times 10^5$ | $1.7 \times 10^7$ |
| *E. coli* | Material of the present invention | $2.6 \times 10^5$ | $3.0 \times 10^5$ |

As shown in the results listed above, the raw material for antibacterial artificial nails of the present invention showed superior antibacterial effects against *Escherichia coli* compared with the control sample that does not contain an antibacterial agent.

EXAMPLE 3

In this experimental example, a mildew resistance test was performed on the raw material, ABS resin, of the antibacterial artificial nail prepared in the aforementioned example. The test method employed was NO. 508.3 of MIL SID 810 D method. The activity of the test bacteria was confirmed by culturing for 10 days before the test began.

A mixed test bacteria spore suspension was inoculated directly by a wet method. A mixed spore suspension was prepared as described below. 62 types of bacteria were employed in the test, including allergy-causing bacteria, pathogenic plant bacteria, respiratory disorder bacteria, and food bacteria such as *Nigrospora oryzae, Cladosporium herbarum, Trichoderma T1, Aspergillus niger, Aspergillus oryzae, Candida albicans, Bacillus subtillis, Pseudomonas aeruginosa, Escherishia coli, and Botrytis cinerea*. To the test bacteria, surfactant (NaCl pure, Tween-80, one part test bacteria, sufofumaric acid dioctylsodium, 10 mL per bacterium), and moisturizing agent (concentration 0.05 g/1000 g) were mixed. The resulting solution was pipetted with a Pasteur pipette and filtered through a glass bead filter. At this point, an Erlenmeyer flask was used to separate the spores (one part test Bacteria). The spores were dispersed with a centrifuge (one part test bacteria). The bacteria were collected with a glass rod, and the spores identified in a vita system. 62 types of test bacteria were mixed in equal parts.

Potato dextrose agar (PDA) that does not contain an antibiotic substance was employed as a culture medium, and a square shaped dish was used.

The culture period was 28 days. The culturing equipment and conditions are described below. A circulator equipped with an automatic temperature and humidity control was employed. The temperature was kept at 30±5° C., and the temperature at transition was 24–35° C. The relative humidity was set at 95 ±5%, and the relative humidity at transition was greater than 90%. Air velocity was 60 cm/second.

To determine whether the conditions in the circulator are suitable for bacterial growth, cotton was immersed in the culture medium, and inoculation was performed in the circulator under the same conditions as for the test sample. The results were evaluated using the following 5-level system.

| Evaluation | Amount of bacterial growth |
|---|---|
| Level 0 | none |
| Level 1 | little |
| Level 2 | slight |
| Level 3 | some |
| Level 4 | considerable |

The evaluation results of bacterial growth in ABS resin for antibacterial artificial nails of the present invention are listed in the table below.

| Sample | after 7 days | after 14 days | after 21 days | after 28 days |
|---|---|---|---|---|
| ABS | level 0 | level 0 | level 0 | level 0 |

As shown in these results, the ABS resin for antibacterial artificial nails of the present invention has an excellent growth inhibition effect on various bacteria.

The present invention provides an artificial nail with excellent antibacterial effects, where microbes like mildew do not grow on the nail after the user has attached the artificial nail for more than 2 weeks. The antibacterial artificial nail of the present invention can be prepared simply by mixing an antibacterial agent in the ABS resin during the artificial nail raw material mixing process. In addition, the present invention prevents nails from being damaged by penetration of bacteria and dirt when the artificial nail is attached for a long time. Therefore, the present invention contributes to the public health because it allows artificial nail consumers to enjoy healthy living.

While there have been described what are presently believed to be the preferred embodiments of the invention, those skilled in the art will realize that changes and modifications may made thereto without departing from the spirit of the invention, and it is intended to include in the claims all such changes and modifications as fall within the scope of the invention.

What is claimed is:

1. An artificial nail comprising an ABS resin containing (i) 3–5% by weight or organic or inorganic antibacterial agents;

(ii) 30–40% by weight of polymer styrene acrylonitrile (SAN); and (iii) 30–50% by weight of acrylonitrile butadiene styrene (ABS) graft copolymer resin powder, whereby said artificial nail is antibacterial.

2. An artificial nail according to claim 1, wherein said organic or inorganic antibacterial agent is thiazole sulfuryl amide of the formula $C_3H_3NS+SO_2(NH)_2$.

3. An artificial nail according to claim 1, wherein said ABS resin further comprises 10–25% of transparent ABS.

4. An artificial nail according to claim 1, wherein said ABS resin further comprises 3–4% of heat stabilizer.

5. An artificial nail according to claim 1, wherein said ABS resin comprises 40% ABS resin powder, 35% SAN, 20% transparent ABS, and 5% antibacterial agent.

6. A method for forming an antibacterial artificial nail comprising (i) copolymerizing butadiene latex with styrene acrylonitrile to obtain acrylonitrile butadiene styrene graft copolymer (graft ABS);

(ii) solidifying said graft ABS of step (i) by dehydrating and drying said graft ABS to obtain ABS resin powder;

(iii) mixing said ABS resin powder of step (ii) with an antibacterial agent to form a mixture; and (iv) injection molding said mixture of step (iii) into an artificial nail product.

7. A method according to claim 6 further comprising compressing said mixture of step (iii) into resin pellets.

8. A method according to claim 6 wherein, one or more additional additives selected from the group consisting of SAN, transparent ABS, and heat stabilizer, are added to the ABS resin powder during step (iii).

9. A method according to claim 7 wherein, a 2-axle mixer at 200–220° C. is employed in the compressing step.

* * * * *

UNITED STATES PATENT AND TRADEMARK OFFICE

CERTIFICATE OF CORRECTION

PATENT NO. : 6,516,812 B2
DATED : February 11, 2003
INVENTOR(S) : Sung Yong Chang It is certified that error appears in the above-identified patent and that said Letters Patent is hereby corrected as shown below:

Column 3,
Line 67, now reads "$10 \times 10^{6}$" should read -- $1.0 \times 10^{6}$ --

Signed and Sealed this

Twenty-sixth Day of August, 2003

JAMES E. ROGAN
*Director of the United States Patent and Trademark Office*